United States Patent [19]

Rodrigue et al.

[11] Patent Number: 4,678,440

[45] Date of Patent: Jul. 7, 1987

[54] BOAT AND PROPULSION SYSTEM

[76] Inventors: Roland Rodrigue; Ronnie Rodrigue, both of 2233 N. Von Braun, Harvey, La. 70058

[21] Appl. No.: 911,748

[22] Filed: Sep. 16, 1986

Related U.S. Application Data

[63] Continuation of Ser. No. 643,123, Aug. 22, 1984.

[51] Int. Cl.[4] ..... B63H 5/12

[52] U.S. Cl. ..... 440/53; 440/63; 114/355

[58] Field of Search ..... 440/49, 53, 57, 63; 114/57, 357, 355

[56] References Cited

U.S. PATENT DOCUMENTS

| | | | |
|---|---|---|---|
| 827,202 | 7/1906 | Bachman | 440/53 |
| 1,316,169 | 9/1919 | Liberty | 440/63 |
| 1,479,025 | 1/1924 | Caille et al. | 440/63 |
| 1,586,517 | 6/1926 | Caille et al. | 440/53 |
| 1,789,415 | 1/1931 | Phillips | 440/53 |
| 1,831,739 | 11/1931 | Decker | 440/63 |
| 2,513,050 | 6/1950 | Pugy | 440/53 |
| 2,996,035 | 8/1961 | Torrey | 440/53 |
| 3,063,404 | 11/1962 | Jones | 440/53 |
| 3,469,558 | 9/1969 | Puretic | 440/53 |
| 3,498,253 | 3/1970 | Wood | 440/53 |

*Primary Examiner*—Joseph F. Peters, Jr.
*Assistant Examiner*—Stephen P. Avila
*Attorney, Agent, or Firm*—George A. Bode; D. Neil LaHaye

[57] ABSTRACT

A boat and propulsion system especially useful for shallow water operation. A boat, such as a flat bottom fishing boat, is provided with a lowered transom and a platform attached to the transom which extends upwardly at an angle along the sides of the boat to define a well area which receives and drains any backwash. An air cooled internal combustion engine is provided with a straight propeller shaft and propeller attached thereto. A motor plate rigidly attached to the engine may be removably mounted on a swivel-hinge assembly mounted on the platform to allow double axis movement of the engine and propeller in relation to the platform. This provides for a thrusting position with the propeller in the water and a neutral position with the propeller held above the water. A control handle may be removably connected to the motor plate to provide one handed steering and throttle control by the operator. The motor plate is detached from the swivel-hinge assembly to allow removal and transportation of the engine and propeller shaft combination in a trunk of an automobile with the control handle removed. The propeller is approximately 95% weedless as it runs at a water level above that from the bottom of the boat during operation and thus need no skegs or deflector plates. A propeller shaft housing and coupling guard are mounted on the engine and enclose the propeller shaft and coupling of the propeller shaft to the engine drive shaft.

7 Claims, 5 Drawing Figures

BOAT AND PROPULSION SYSTEM

This is a continuation of application Ser. No. 643,123, filed Aug. 22, 1984.

BACKGROUND OF THE INVENTION

1. Field of the Invention

The present invention is related to boats and more particularly is related to boats and propulsion systems designed for shallow water operation.

2. General Background

Sportsmen such as fisherman, trappers and hunters and particularly duck hunters are often faced with the necessity of navigating a variety of waterways in order to travel to locations which offer ideal conditions for these activities. Marshes, swamps and bayous frequently present ideal locations but offer limited accessibility due to shallow water conditions, weeds and a variety of shallow underwater obstacles which may make travel by boat using conventional inboard or outboard propulsion engines impractical if not impossible. Traveling on foot is impractical as long distances must often be covered to reach suitable hunting and fishing locations. Also, travel by foot is impractical as it is often necessary to transport extra equipment and supplies for building and/or maintaining equipment structures at hunting sites such as duck blinds.

Many hunters and fishermen utilize small boats such as pirogues having a shallow draft similar to a canoe which may be paddled or poled through shallow water. Although this provides a method of travel in the above conditions, it presents the disadvantages of consuming excess time and energy to arrive at a desired location.

Patents in this area of which applicants are aware include the following.

U.S. Pat. No. 1,831,739, issued to Decker, entitled "Motor Mounting" discloses a method of mounting a motor which provides for use of conventional inboard engines as outboard motors. The boat is cut away in the rear to form a forward cutout in the transom. The sides of the transom are provided with motor supporting plates secured to the sides of the transom which have a vertical slot and downwardly extending recessed slots connected therewith. The motor is provided with extending lugs which terminate in heads. The lugs are received by the slots and may be selectively placed in the recessed slots to allow adjustment of the angle of the motor and propeller shaft in the water. Vertical brackets are provided on the sides of the transom and rearwardly of the plate. Brackets are provided with apertures to receive a bolt which passes through the upper ends of tie rods which are secured to the casing of the propeller shaft. The motor may be adjusted through use of the brackets and slots to provide for a variety of angles of the propeller shaft in the water.

U.S. Pat. No. 1,316,169, issued to Liberty, entitled "Detachable Power Driven Propeller For Boats" discloses an internal combustion engine mountable on the transom of a boat and adjustable to provide for adjusting the angle of the propeller in the water. The engine is pivotally mounted on a mounting bracket and pivotal mount to provide for forward and rearward tilting of the engine on the mounting bracket. This allows for adjustment of the angle of the propeller in the water. The engine is secured on the rear of the boat by a mounting bracket. The angle of the propeller may be secured by adjusting nuts on the bracket with a wing nut. The propeller shaft is received by a housing which is supported by a spider-like frame.

U.S. Pat. No. 2,513,050, issued to Pugh, entitled "Power Driven Propelling Installation For Boats" discloses an internal combustion engine having a straight propeller shaft mounted to a boat by means of a transverse bracket which fits over the top of the transom. The engine is pivotally connected to the transom bracket to allow vertical and lateral movement of the motor and propeller. The propeller shaft is capable of being broken down into two sections at approximately its midpoint by loosening at a joint so that the apparatus may be more easily transported.

U.S. Pat. Nos. 827,202; 1,479,025; 1,586,517; 1,953,599; 3,498,253; and Pat. No. Des. 259,488 disclose engines which may be pivotally mounted on transom plates so that the angle of the straight propeller shaft is adjustable relative to the water.

None of the above patents provide for a boat and motor which may be used for shallow water operation while also providing an engine and propeller shaft which is light enough and small enough so that it may easily be attached to and removed from a boat by one person. An important feature also not provided is a motor and propeller shaft which is small enough to be easily transported in the trunk of an automobile without the need for breaking down important portions of the unit such as the propeller shaft. Providing a propeller shaft which must be broken down into sections for transportability increases the complexity of the unit by the addition of joints and connectors in a critical area of the unit. This also increases the degree of difficulty and amount of time and effort required in setting up and taking down the unit.

GENERAL DISCUSSION OF THE PRESENT INVENTION

The present invention solves the aforementioned problems in a straightforward manner. What is provided is a boat having a modified transom, angled engine mounting platform for removably attaching an engine to said boat and a straight propeller shaft for mounting on an engine. The transom is cut down from the top of the boat to provide a transom height of approximately nine inches from the bottom of the boat to the top of the lowered transom. An angled platform is provided at the stern of the boat for mounting an engine thereupon. The platform extends upward toward the bow of the boat and is integrally attached to the transom and sides of the boat to receive and drain any backwash of water out of the boat which may be received over the lowered transom. An air cooled internal combustion engine is mounted on a motor plate adapted to be pivotally mounted to the angled platform and a straight propeller shaft is coupled to the motor shaft for providing thrust to the boat when in shallow or deep water. A control handle removably mounted on the motor plate provides an engine throttle control and means for controlling directional thrust of the propeller and the angle of the propeller and propeller shaft relative to the water surface. The engine is easily removed from the boat and light enough to be carried by one person. The engine and propeller shaft, with the control handle removed from the motor plate is short enough so as to fit into the trunk of an automobile.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and, wherein.

DETAILED DESCRIPTION OF THE PREFERRED EMBODIMENT

Figure 1:
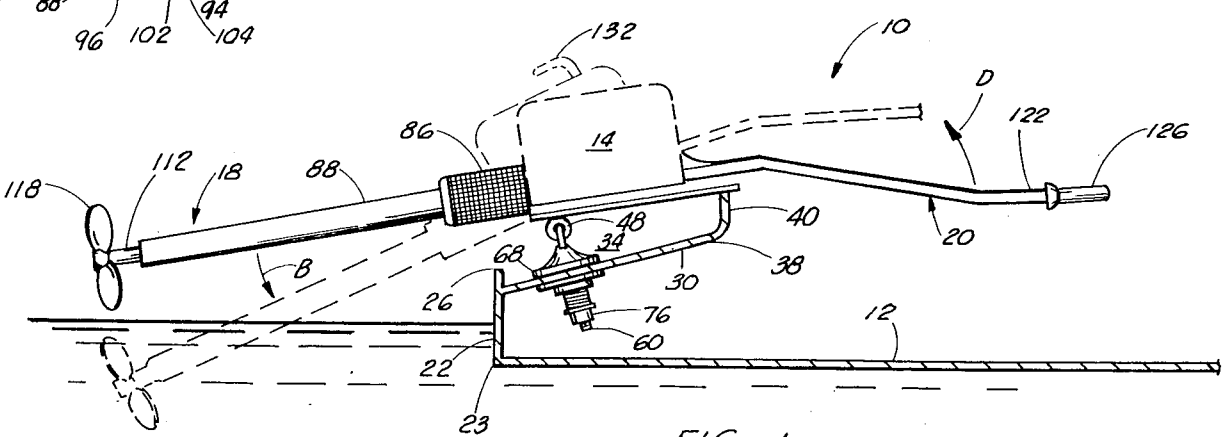
FIG. 1 is a partial side sectional view of the apparatus.

Referring now to the drawings and particularly FIG. 1, it can be seen that the boat and propulsion system apparatus is generally referred to by the numeral 10. Apparatus 10 is generally comprised of boat 12, engine 14, means 16 best seen in FIG. 3 for pivotally attaching engine 14 to boat 12, means 18 connected to engine 14 for providing thrust to boat 12 and means 20 for steering boat 12.

Boat 12 may be any of a general purpose boat having a shallow draft constructed of metal such as aluminum or fiberglass but is preferably a flat bottom fiberglass boat having a shallow draft so that the modifications required for mounting means 16 for pivotally attaching engine 14 thereto are accomplished in an easier manner.

Figure 5:
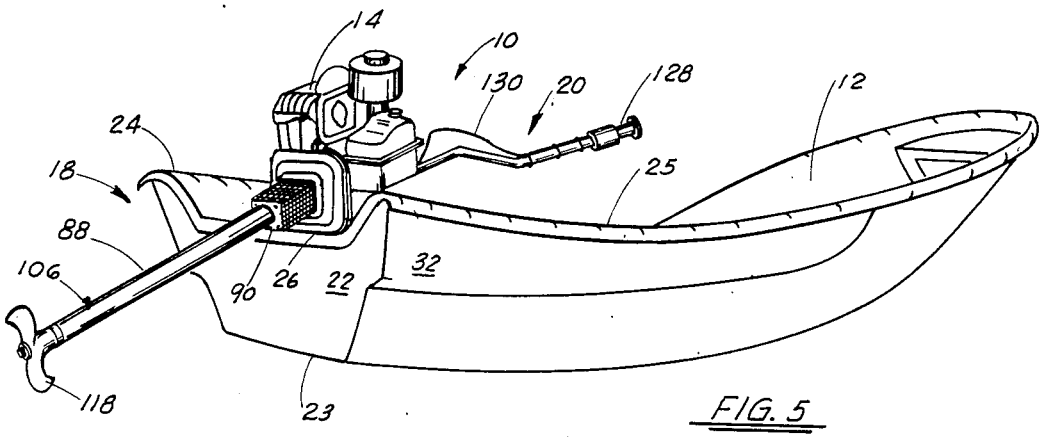
FIG. 5 illustrates the engine as it appears mounted on the angled platform of the boat.
Figure 4:
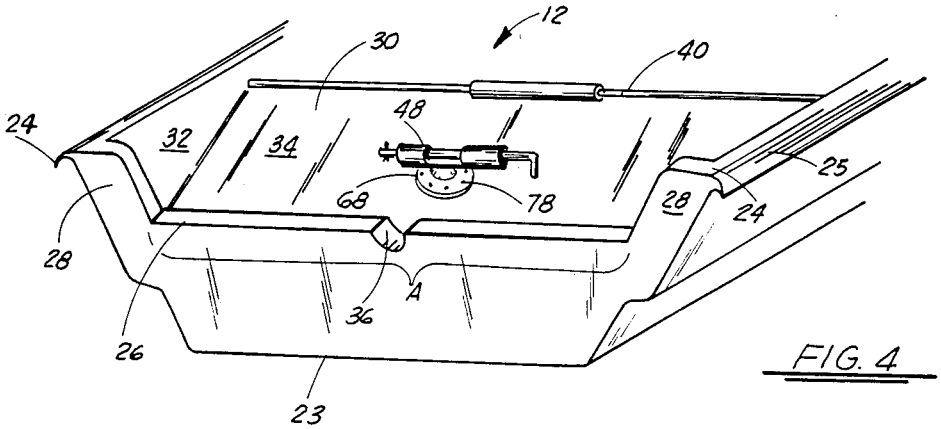
FIG. 4 illustrates the hinge assembly as it appears installed on the angled platform.

Boat 12 begins as a conventional flat bottom boat having a transom 22 which extends from the bottom 23 of boat 12 to the top of stern posts 24 to provide a transom 22 which extends across the width of the stern of boat 12 substantially at a height equal to that of stern posts 24 and gunnels 25. Boat 12 is then modified by having transom 22 shortened from the top down to point 26, as seen in FIGS. 1, 4 and 5, which provides transom 22 with a height of approximately nine inches between bottom 23 and point 26. Transom 22 is not cut down the entire width of boat 12 but is cut out to provide a minimum width of approximately 30 inches as indicated by space A so that engine 14 and means 18 for providing thrust to boat 12 may pivot sufficiently to provide adequate steering to boat 12 during use. It should be noted that portions 28 of transom 22 which remain at their original highest point connected to stern post 24 may be eliminated, thus having the cut out of transom 22 extending the entire width of boat 12, but serve when left in tact to provide structural rigidity of stern posts 24 with transom 22, prevent sharp and dangerous corners on boat 12 and provide a better esthetic appearance at the stern of boat 12.

A second modification to boat 12 is that of installing angled platform 30. Platform 30 is attached to the interior of transom 22 and sides 32 to define a well 34 for receiving any backwash of water which may be received over transom 22 into boat 12. Platform 30 is attached to transom 22 and sides 32 so as to be water tight along the edges to prevent any water received into well 34 from entering boat 12. Platform 30 is also attached so that it may serve as a load bearing platform for supporting engine 14, the means for mounting to be discussed further. The rear of platform 30 is attached to transom 22 at a point approximately seven inches above bottom 23 of boat 12. Notch 36 seen in FIG. 4 is provided in the upper and substantially center portion of transom 22 to provide a means for draining of any water which may be received by well area 34. As best seen in FIGS. 1 and 4, platform 30 extends upward and forward in boat 12 from its point of attachment to transom 22. In the preferred embodiment, platform 30 extends forward over a horizontal distance of approximately 14 inches and upward approximately three inches from the point of attachment with transom 22. This provides the preferred angle for mounting of engine 14 and propulsion means 18. Platform 30 is provided at its forward end 38 which an upwardly extending flange 40. In the preferred embodiment, flange 40 extends approximately one inch above platform 30 to aid in retaining any water backwash within well 34 while still allowing proper side to side operation of steering means 20.

It should be noted that transom 22 may be lowered to the point of attachment with platform 30 but is maintained at the height as described above in the preferred embodiment to limit the intake of backwash into well area 34 while allowing proper angular adjustment of propulsion means 18 relative to the water as illustrated in FIG. 1.

Engine 14 is a conventional air cooled internal combustion engine commonly used in industrial applications such as powering water pumps or the like. In the preferred embodiment, a Briggs and Stratton 5 or 8 horse power engine is used but similar engines produced by a variety of manufacturers such as Honda, Tecumseh, or the like may be used with equal ease and effectiveness.

Figure 2:
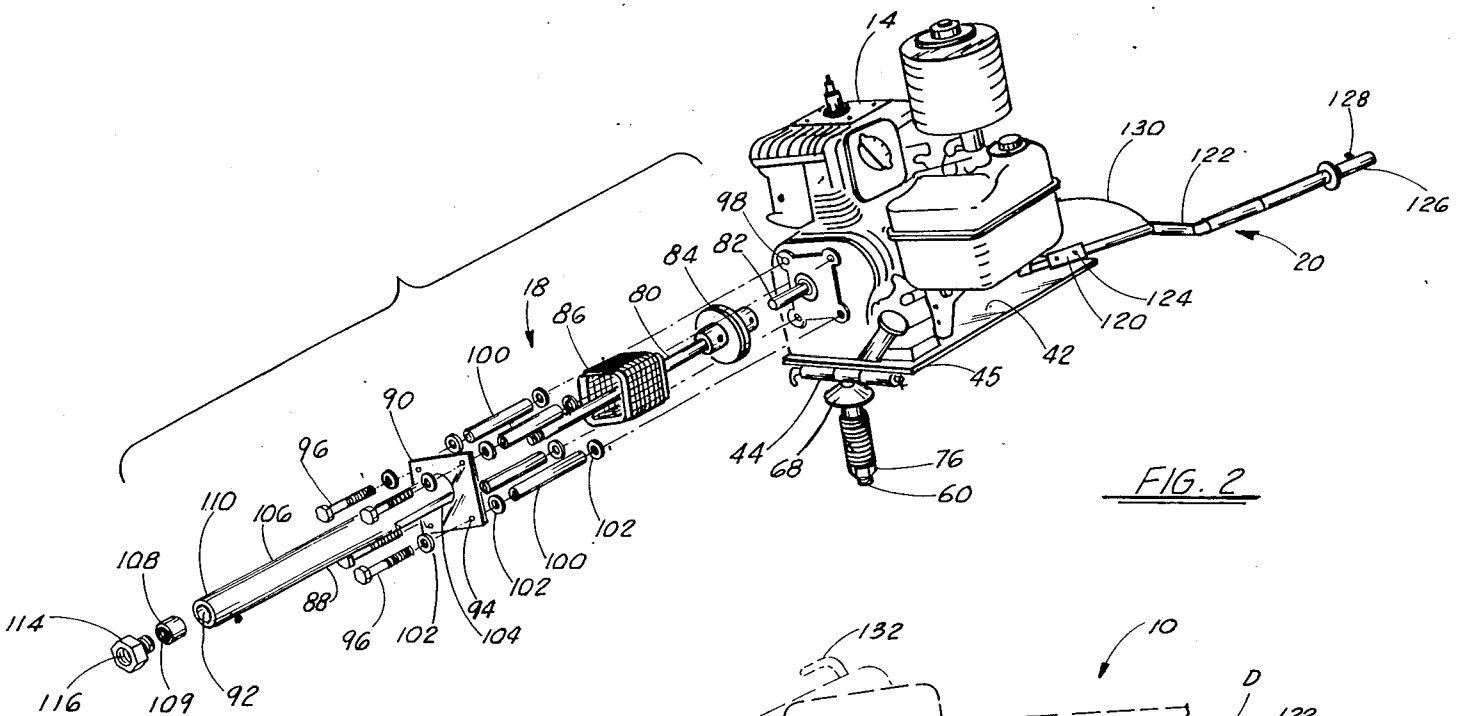
FIG. 2 is an overall view of the engine and mounting assembly and a blowup of the propeller shaft assembly.
Figure 3:
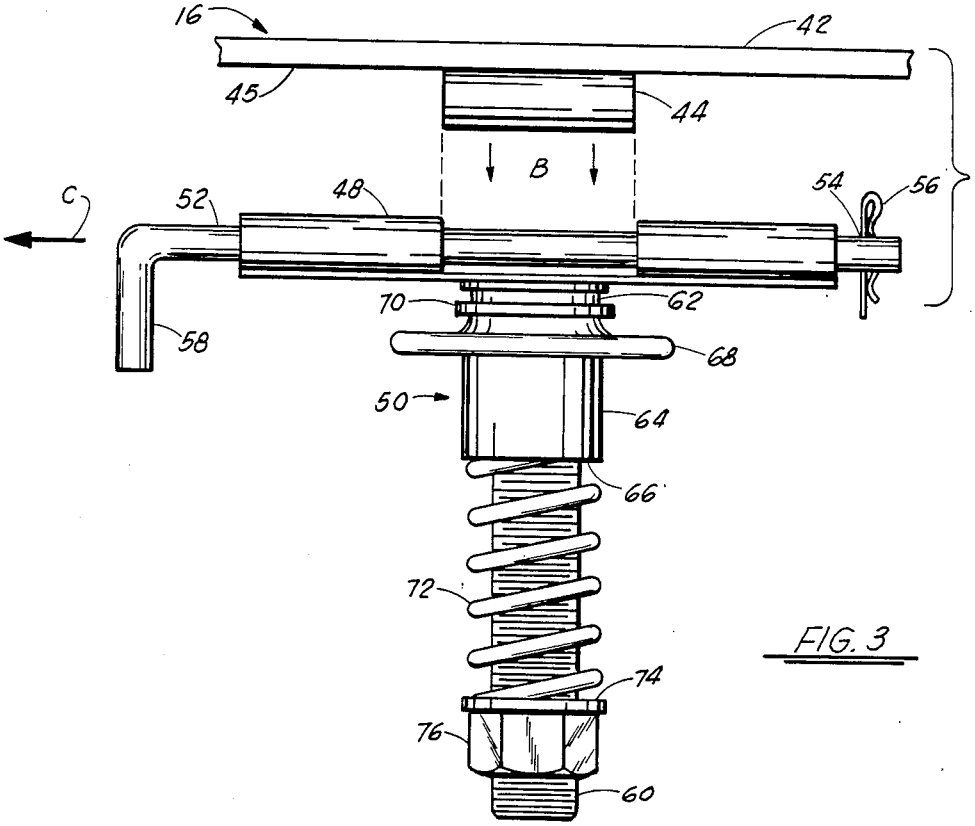
FIG. 3 is a view of the hinge assembly and a partial view of the motor plate as it fits therein.

Means 16 for pivotally mounting engine 14 to boat 12 is provided and is generally comprised of motor plate 42 and hinge assembly 46 as best seen in FIGS. 2 and 3.

Motor plate 42 is preferably a flat rectangular shaped plate constructed of a suitable rigid material such as aluminum or other metal and is adapted to have engine 14 rigidly attached thereto by the use of conventional bolts not shown or other suitable fastening means. Motor plate 42 is provided with cylindrical flange 44 attached to plate 42 by welding or the like. Flange 44 extends downwardly from substantially the center of the rear edge 45 of plate 42 as best seen in FIGS. 2 and 3. Flange 44 is provided with a longitudinal bore not shown therethrough which is substantially parallel to rear edge 45, defining an upper hinge half, and is adapted to be hingedly received by hinge assembly 46.

Hinge assembly 46 is generally comprised of lower half hinge 48 and swivel plate assembly 50.

Lower hinge half 48 is adapted to hingedly receive flange 44 of motor plate 42 and is provided with a longitudinal bore not shown to receive hinge pin 52. As seen in FIGS. 2 and 3, hinge pin 52 may be inserted through the bores provided in flange 44 and lower hinge half 48 after they have been fit together, as indicated by ARROW C in FIG. 3 to retain motor plate 42 in hinged relationship with lower half hinge 48. Hinge pin 52 is provided with bore 54 at one end to receive cotter pin 56 therethrough and handle portion 58 at the opposite end at approximately a 90° angle to the main portion of hinge pin 52 for maintaining hinge pin 52, motor plate 42 and lower half hinge 48 in hinged relationship during use of apparatus 10. Threaded bolt 60 has its head 62 rigidly attached at substantially the center of lower half hinge 48 and at substantially a 90° angle to lower half hinge 48 for pivotal connection to swivel plate assembly 50. Swivel plate assembly 50 is comprised of tube 64 having a longitudinal bore 66 therethrough adapted to receive bolt 60 and radially extending flange 68 attached by welding or the like adjacent one end thereof. Lower half hinge 48 and swivel plate assembly 50 are pivotally attached together to form hinge assembly 46.

Bolt 60 is inserted through swivel plate washer 70 and then through bore 66 in tube 64. An upper spring washer not shown is then placed on bolt 66 and positioned in bore 66, spring 72 is positioned on bolt 60 and in bore 66, lower spring washer 74 is placed on bolt 60 abutting spring 72 and threaded nut 76 is then threaded on bolt 60 as illustrated in FIG. 3 to retain the entire assembly together. In the preferred embodiment, nut 76 is a self-locking nut to prevent nut 76 from backing off bolt 60 during use of apparatus 10. Spring 72 serves the purpose of maintaining tension on motor plate 42 when mounted with hinge assembly 46 to minimize or prevent vibration of motor plate 42 and engine 14 during use of apparatus 10.

Hinge assembly 46 is then attached to platform 30 of boat 12 in the following manner. A bore not shown is provided in platform 30 substantially along the center line of boat 12 and positioned preferably in the range of 2–4 inches forward of the point where platform 30 joins transom 22. The bore is sized so as to receive threaded bolt 60, nut 76 and tube 64 but not allow flange 68 to fit therein. This allows flange 68 to rest on platform 30 and provide support for hinge assembly 46, motor plate 42 and engine 14. Hinge assembly 46 is then attached to platform 30 by bolts or rivets 78, seen in FIG. 4, which are provided through flange 68 and attached to platform 30. When attached to platform 30, flange 68 remains stationary but lower half hinge 48, due to swivel plate washer 70 and connection with the upper spring washer and lower spring washer 74 allow lower half hinge 48 to rotate above flange 68. This provides for rotational movement of motor plate 42 and engine 14 on hinge assembly 46 when motor plate 42 is engaged with hinge assembly 46.

Means 18 for providing thrust is best seen in FIG. 2 and is generally comprised of the following. A propeller shaft 80 is engaged with drive shaft 82 of engine 14 by coupling 84. Coupling 84 is of a conventional type and is preferably adjustable to fit shafts having an outer diameter of $\frac{3}{4}$ inch to $\frac{5}{8}$ inch. Propeller shaft 80 may be constructed of any suitable rigid material such as metal and is preferably $\frac{5}{8}$ inch in diameter and approximately 36 inches in length.

Once propeller shaft 80 is engaged with drive shaft 82 by coupling 84, propeller shaft 80, drive shaft 82 and coupling 84 are enclosed by coupling guard 86 and propeller shaft housing 88. Coupling guard 86 serves to prevent injury by enclosing coupling 84, drive shaft 82 and that portion of propeller shaft 80 adjacent engine 14 and not covered by shaft housing 88. Coupling guard 86 may be constructed of any suitable material but in the preferred embodiment is a wire mesh in the form of a cube or cylinder having both ends open. Coupling guard 86 is maintained in position against engine 14 by shaft housing plate 90. Plate 90 is a square or rectangular flat plate attached to one end of shaft housing 88 by welding or the like and is provided with an aperture not shown in coaxial alignment with bore 92 in shaft housing 88. As best seen in FIG. 5, plate 90 is preferably sized so as to match the size of guard 86. Plate 90 is provided with apertures 94 adjacent each corner for the passage of threaded bolts 96 therethrough and threaded engagement in threaded bores 98 provided on engine 14. This serves to fasten shaft housing 88 around propeller shaft 80 and retain guard 86 around coupling 84 by having guard 86 positioned between plate 90 and engine 14. Spacers 100 are provided for receiving bolts 96 and fit interior of guard 86 adjacent each corner. Washers 102 are provided with bolts 96 and spacers 100 and preferably comprise at least one set of lock washers.

Shaft housing 88 is provided with ribs 104, only one being illustrated, which are rigidly attached to plate 90 and shaft housing 88 and extend partially along the length thereof. Ribs 104 serve to strengthen the point of attachment of plate 90 to shaft 88. Shaft housing 88 is provided near the opposite end with grease fitting 106 for shaft 88 to be greased without the necessity for breaking down propulsion means 18. Bushing housing 108 is inserted into the end of shaft housing 88 opposite plate 90 and is retained in position by rivets 110. Bushing housing 108 has bore 109 therethrough for receiving propeller shaft 80 and allowing end 112 of propeller shaft 80 to extend beyond the end of shaft housing 88. Bushing housing 108 has bore 109 threaded to threadably engage threaded end bushing 114. Bushing 114 is preferably constructed of brass to resist corrosion and is provided with bore 116 to receive end 112 of propeller shaft 80 therethrough with bore 116 being sized slightly larger than propeller shaft 80 to allow rotation of propeller shaft 80 therein with a minimum of wobble. Propeller 118 is attached to end 112 of propeller shaft 80 in the conventional manner by the use of a threaded nut and cotter pin not shown and is also linked with shaft 80 for propulsion by a shear pin not shown which may be easily replaced. It can be seen that propulsion means 18 provides a direct drive so that propeller 118 will be caused to rotate whenever engine 14 is running but will not always provide forward thrust as means 20 for steering allows the operator of apparatus 10 to cause propeller 118 to be raised above the water level to a non-thrust or neutral positioned while engine 14 is running.

Means 20 for steering is generally comprised of handle plate 120 rigidly attached to motor plate 42 and handle 122 which may be removably attached to handle plate 120 by use of bolts 124. Conventional nuts or wing nuts may be used for quick and easy attachment/detachment of handle 122 to handle plate 120. As best seen in FIG. 2, the rigid attachment of handle 122 to handle plate 120 allows the operator to steer apparatus 10 by side to side motion of motor plate 42 on hinge assembly 46. As seen in FIG. 1, deflection of propeller 118 as indicated by ARROW B between the neutral position and the driving position illustrated in phantom view, may also be controlled by upward and downward deflection of handle 122 as indicated by ARROW D. Handle 122 is provided with a handle grip 126 which may be a conventional rubber handle grip. Throttle lever 128 is provided on handle grip 126 and is connected with throttle cable 130 to engine 14 to provide the operator with a means of controlling steering and throttle with one hand.

In operation, engine 14, thrust means 18 and means 20 for steering may be easily transported in a trunk of an automobile as handle 122 is easily removed from handle plate 120. This provides an overall length of approximately 48 inches from propeller 118 to the front of engine 14 and motor plate 42 with handle 122 removed. Engine 14 and thrust means 18 do not have to be broken down and may be easily transported by one person from an automobile and installed on boat 12 by the use of carrying handle 132 illustrated in FIG. 1 as the assembly weighs approximately 45 pounds. Upper half hinge 44 is then mated with lower half hinge 48, hinge pin 52 is inserted therethrough and cotter pin 56 is inserted through bore 54 to retain the pieces in hinged connection as illustrated in FIG. 3. The mounting of engine 14 to boat 12 then appears as illustrated in FIGS. 1 and 5 and apparatus 10 is ready for operation in shallow or deep water after handle 122 has been attached to motor plate 120. Engine 14 is then started with handle 122 in its lower position as illustrated in FIG. 1 so that propeller 118 is out of the water in the neutral position. The operator then raises handle 122 in the direction indicated by ARROW D to cause deflection of propeller 118 as indicated by ARROW B by pivoting of motor plate 42 with hinge assembly 46, into the water to provide forward thrust to boat 12. The engine speed may be controlled by throttle lever 128 while steering apparatus 10 and controlling the angle of propeller 118 in the water. During operation, the angle of means 18 for thrust to the water level is approximately 12° to 20°. Skegs and deflector plates are not necessary to protect propeller 118 from weeds or other obstacles as propeller 118 is normally at a level in the water which is higher than bottom 23 of boat 12 when in forward motion. This allows propeller 118 to be approximately 95% weedless. The preferred downward angle of handle 122 illustrated in FIGS. 1, 2 and 5 prevent accidental 180° pivoting of propeller 118 into the passenger area of boat 12 as the interior sides 32 or gunnels 25 of boat 12 limit side to side movement of handle 122 when in the neutral position. If necessary, a shear pin is easily changed without the necessity for leaving boat 12 or leaning out over the edge by shutting off engine 14, removing handle 122 and then pivoting engine 14 so that propeller 118 is above the passenger area of boat 12. Any backwash of water over transom 22 which may occur is received in well area 34 which is defined by angled platform 30 and the sides of boat 12 and is automatically drained via notch 36, thereby preventing any backwash from remaining in boat 12. During operation, the tension maintained on motor 42 and hinge assembly 46 by spring 72 helps to minimize or prevent any unnecessary up and down jarring or bouncing of engine 14.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A boat and propulsion system, comprising:

a. a boat having a transom having a substantially planar horizontal upper surface extending side by side of said boat and being lower than the height of the gunnels of said boat, said transom transitioning from said substantially horizontal upper surface to substantially vertical surfaces at its extremities, said vertical surfaces merging with said gunnels;

b. a generally planar platform integrally attached to the side walls and said transom of said boat and defining a well area within said boat for receiving and draining backwash from said boat, said platform being inclined at an angle to the horizontal from said transom forward;

c. means for providing thrust to said boat, said means being removably mounted on said platform above and displaced forward of said transom and pivotal between a first neutral position and a second thrusting position;

d. means for limiting the angle of pivot of said thrusting means, said limiting means including said horizontal upper surface of said transom; and e. means for limiting the rotational movement of said thrusting means, said limiting means including said vertical surfaces of said transom.

2. The apparatus of claim 1, wherein said platform is attached to said transom at a point approximately seven inches above the bottom of said boat and extends upward at an angle of 12°–20° to a point approximately 10 inches above the bottom of said boat.

3. The apparatus of claim 1, wherein the height of said transom is approximately nine inches from the bottom of said boat.

4. The apparatus of claim 1, wherein the height of said transom is approximately seven inches from the bottom of said boat.

5. The apparatus of claim 1, wherein said boat comprises a flat bottom boat.

6. The apparatus of claim 1, wherein said means for providing thrust comprises:

a. an engine pivotally mounted on said platform and pivotal between a first neutral position and a second thrusting position;

b. a propeller shaft in driven engagement with the drive shaft of said engine and extending rearwardly over said transom; and c. a propeller attached to the end of said propeller shaft opposite said engine.

7. A boat and propulsion system, comprising:

a. a boat having a transom having a substantially horizontal upper surface extending side to side of said boat and being lower than the height of the gunnels of said boat, said transom transitioning from said substantially horizontal upper surface to substantially vertical surfaces at its extremities, said vertical surfaces merging with said gunnels;

b. a generally planar platform attached to the side walls and said transom of said boat and defining a well area within said boat for receiving and draining backwash from said boat, said platform being inclined from said transom forward;

c. means for providing thrust to said boat, said means being mounted on said platform above and displaced forward of said transom and pivotal between a first neutral position and a second thrusting position;

d. means for limiting the angle of pivot of said thrusting means, said limiting means including said substantially horizontal upper surface of said transom; and e. means for limiting the rotational movement of said thrusting means, said limiting means including said substantially vertical surfaces of said transom.

* * * * *

UNITED STATES PATENT AND TRADEMARK OFFICE

CERTIFICATE OF CORRECTION

PATENT NO. : 4,678,440

DATED : July 7, 1987

INVENTOR(S) : Roland Rodrigue et al

It is certified that error appears in the above-identified patent and that said Letters Patent is hereby corrected as shown below:

The term of this patent subsequent to June 30, 2004 has been disclaimed.

Signed and Sealed this

Twenty-ninth Day of September, 1987

*Attest:*

DONALD J. QUIGG

*Attesting Officer* *Commissioner of Patents and Trademarks*